United States Patent [19]

Conner

[11] Patent Number: 4,741,283

[45] Date of Patent: May 3, 1988

[54] BOAT SECURER

[76] Inventor: Ellis Conner, P.O. Box 26, Crestview, Fla. 32536

[21] Appl. No.: 926,669

[22] Filed: Nov. 4, 1986

[51] Int. Cl.[4] ..... B63B 21/00

[52] U.S. Cl. ..... 114/230; 114/221 R; 294/118

[58] Field of Search ..... 114/221 R, 230; 294/19.1, 19.2, 19.3, 82.24, 82.25, 118

[56] References Cited

U.S. PATENT DOCUMENTS

| | | | |
|---|---|---|---|
| 113,126 | 3/1871 | Ziegler et al. | 294/118 |
| 2,653,574 | 9/1953 | Spencer | 294/118 |
| 2,913,797 | 11/1959 | Hollis et al. . | |
| 2,956,531 | 10/1960 | Banker . | |
| 2,983,243 | 5/1961 | Bowers et al. . | |
| 3,273,928 | 9/1966 | Wisniewski . | |
| 3,403,431 | 10/1968 | Butler . | |
| 3,945,335 | 4/1976 | Kratz . | |
| 4,281,612 | 8/1981 | Watts | 114/221 R |
| 4,414,712 | 11/1983 | Beggins . | |
| 4,518,184 | 5/1985 | Pecorini . | |

*Primary Examiner*—Joseph F. Peters, Jr.
*Assistant Examiner*—Stephen P. Avila
*Attorney, Agent, or Firm*—Banner, Birch, McKie & Beckett

[57] ABSTRACT

The present invention is directed to a mooring device for more quickly, safely and securely mooring a boat to a stationary object. The device includes first and second opposed, inwardly curving arms forming a jaw portion and a handle portion extending from each of the arms. The arms are coupled by a fastener located adjacent the handle portions. A resilient member couples the arms intermediate the fastener and the other end of the jaw portion to hold the jaw portion in a normally closed position while yielding to allow the jaw portion to open when the handle portions are drawn together. A tie-line extends from the first arm, to the second arm, through the first handle portion and to the boat to be secured.

13 Claims, 2 Drawing Sheets

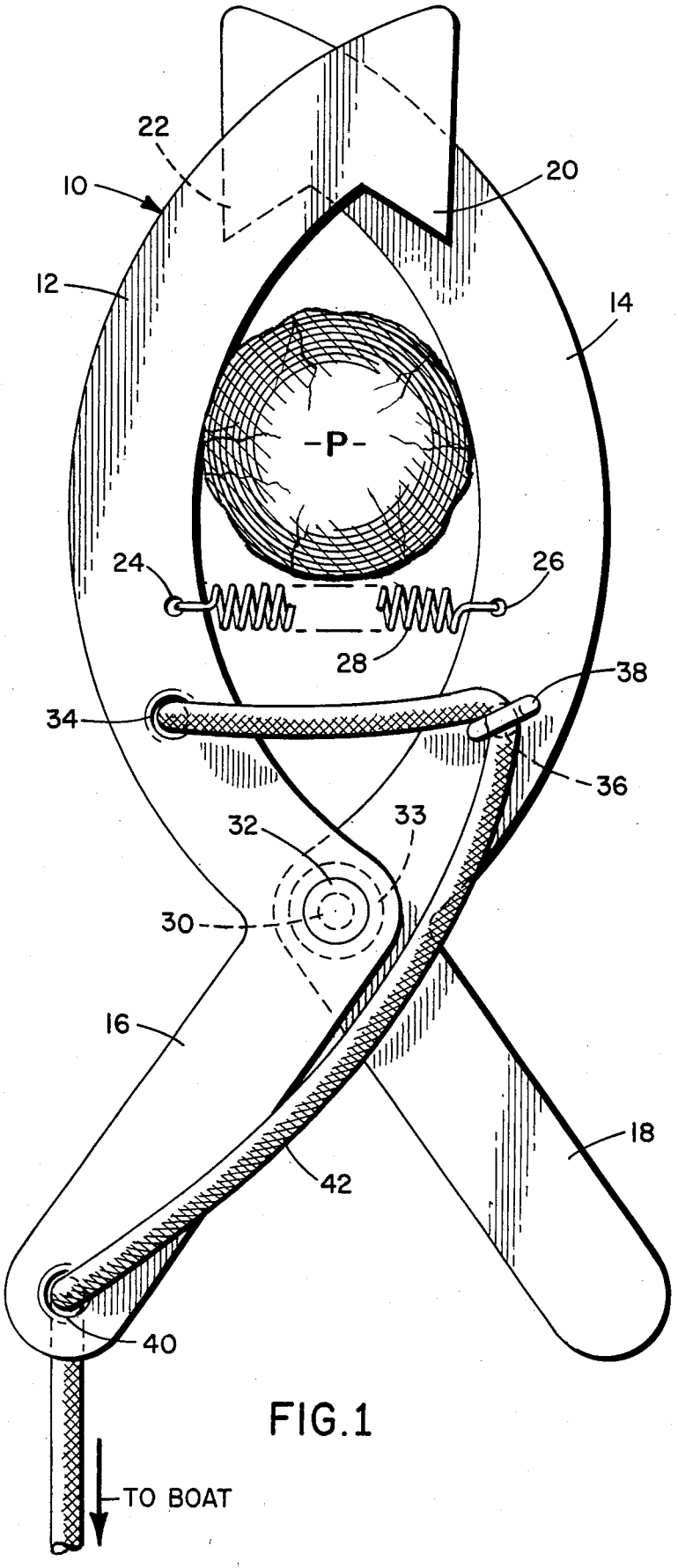
FIG.1
FIG. 2
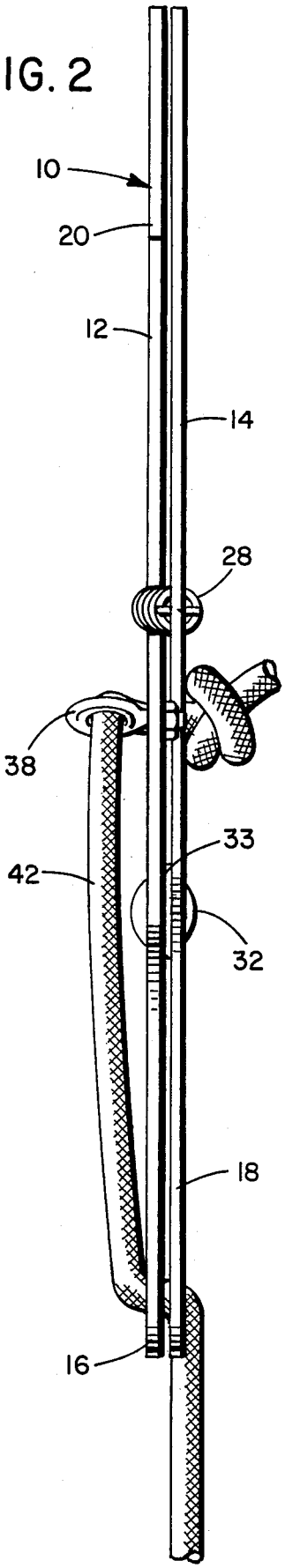

BOAT SECURER

BACKGROUND OF THE INVENTION

The present invention is directed to a mooring device for boats and, more particularly, to a mooring device of simple construction which may be attached or detached from a stationary object using only one hand.

Typically, a simple rope is used to lash a boat to a dock or to a tree, root, etc., when fishing or boating. However, tying-off a rope requires two hands while the fisherman leans over the boat in a usually precarious position. Clearly, this can be dangerous as the fisherman may be knocked off balance and fall into the water. At best, it is a time-consuming process which results in a somewhat unsecure attachment, as the knot may easily become untied.

An early improvement on the above is disclosed in U.S. Pat. No. 2,913,797, to Hollis et al. Hollis is directed to a mooring device including a pair of concave arms pivotally connected intermediate the length of the arms. A double pronged point is mounted on one end of each arm. A pulley is disposed on each arm adjacent the points. The pulleys accommodate a rope which extends along one arm, over the pulley of the first arm, over the pulley of the second arm, and back along the second arm. The arms are held in a closed position by a weak spring located at the pivot point. When the arms are opened, they may be placed around a stationary object to secure the boat. When the rope is tensioned by the drift of the boat away from the point of fastening, pressure is imparted through the catenary (between the pulleys) upon the grasp point to further impel it upon the piercing points. However, such an arrangement as disclosed by Hollis et al is relatively complex in construction. Moreover, after repeated extension and return, springs tend to lose their elasticity and need to be replaced. Yet the construction of Hollis et al makes it difficult to replace worn parts.

SUMMARY OF THE INVENTION

An object of the present invention is provide a mooring device which allows a boat to be secured to a stationary object in a safe, fast and secure manner.

A further object of the present invention is to provide a mooring device as above which may be attached and detached to the stationary object using only one hand.

A further object of the present invention is to provide a mooring device as above in which the grip of the device on the stationary object increases as the boat drifts away.

A further object of the present invention is to provide a mooring device as above which is of simple construction and which allows easy replacement of worn parts.

The present invention is directed to a mooring device for securing a boat to any convenient stationary object, such as a dock, root, tree, etc., including first and second opposed, inwardly curving arms forming a jaw portion and handle portions extending from one end of each of the arms. The arms are fastened adjacent the handle portions by, for example, a bolt or rivet. A resilient member is coupled between the first arm and the second arm to hold the jaw portion in a normally closed position while yielding to allow the jaw portion to open when the handle portions are drawn together. A tieline extends from a hole located between the fastener and the resilient member on the first arm to a hole located between the fastener and resilient member on the second arm and then to a hole formed in the end of the handle portion of the first arm. An eye bolt is preferably secured in the hole in the second arm to accommodate the tie-line in sliding relation with the second arm. Likewise, the tie-line may slide relative to the hole formed in the handle portion. This arrangement provides that the grip of the mooring device increases as the boat drifts from the stationary object to which the boat is moored.

BRIEF DESCRIPTION OF THE DRAWINGS

FIG. 1 is a plan view of the mooring device in accordance with the present invention, illustrated in a closed position around a small tree trunk or branch;

FIG. 2 is a side elevational view of the mooring device shown in FIG. 1;

DETAILED DESCRIPTION OF THE PREFERRED EMBODIMENT

Figure 3:
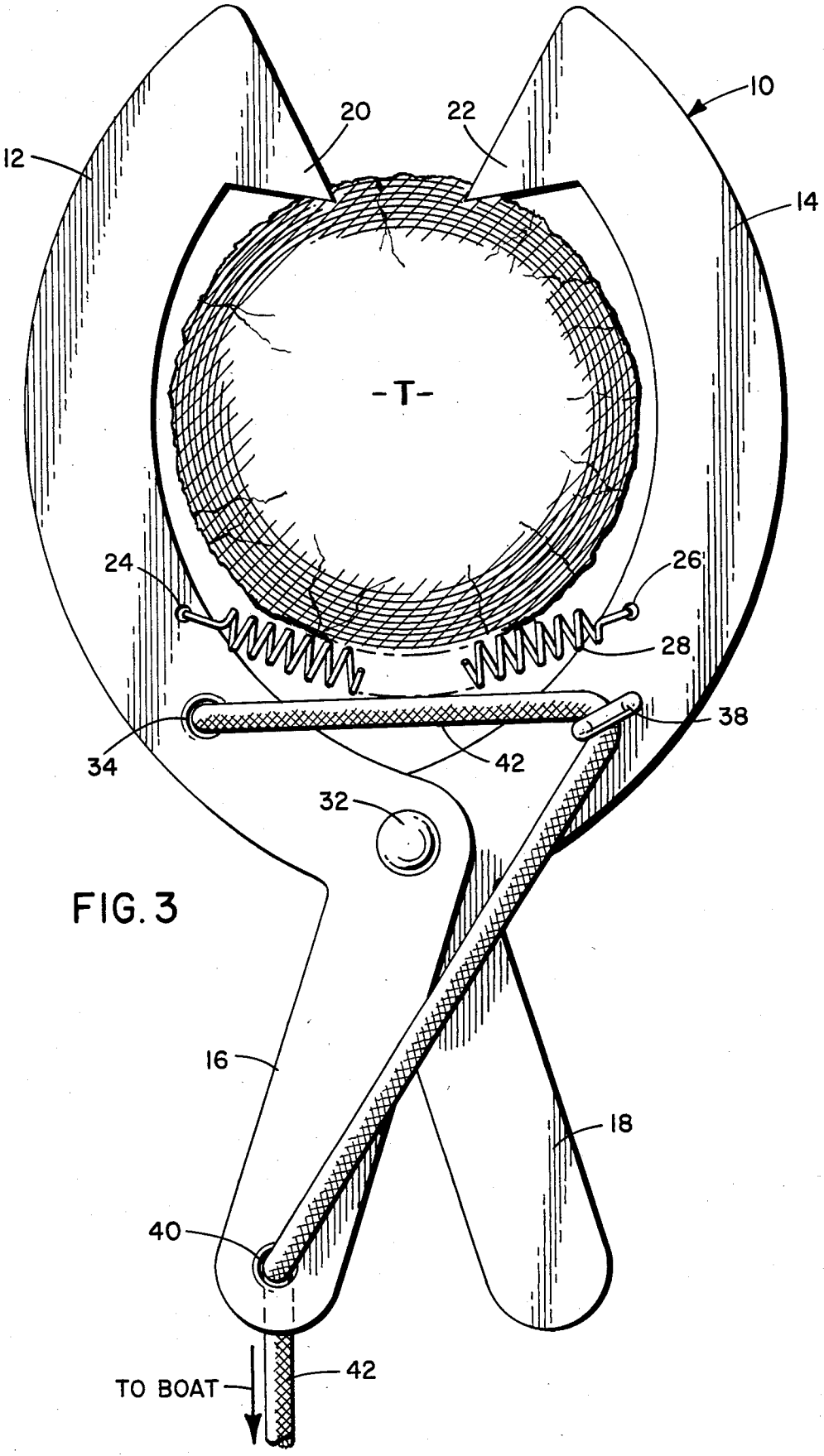
FIG. 3 is a plan view of the present invention, illustrated in a clamped position around a larger tree trunk or branch.

A mooring device in accordance with the present invention is illustrated in FIG. 1 and generally designated 10. Mooring device 10 includes first and second opposed inwardly curving arms 12, 14 forming a jaw portion. First handle portion 16 extends from one end of first arm 12 and second handle portion 18 extends from one end of second arm 14. First and second handle portions 16, 18 form a grip which may be grasped by a fisherman using only one hand, to engage and disengage the mooring device from any convenient stationary object, as will be further described below. First arm 12 and second arm 14 preferably have first and second hook portions 20, 22 formed at their other ends to further facilitate the gripping of the stationary object at the point of fastening.

The first and second arms are connected to one another at a pivot point located at the one end of the arms adjacent the handle portions by a fastener 32 inserted through fastener hole 30. Fastener 32 may be of any suitable type, such as a bolt, a rivet or the like. A spacer element 33, such as a washer or the like, may be disposed between the first and second arms at the pivot point. A resilient member 28 is coupled between first arm 12 and second arms 14 through first and second spring holes 24, 26. Resilient member 28 holds the jaw portion in a normally closed position while yielding to allow the jaw portion to open when the handle portions are drawn together. The resilient member may be of any suitable type, such as a spring, elastic band, or the like.

Tie line 42 is secured to first arm 12 through first tie-line hole 34. The tie-line may be secured in any suitable manner so that it cannot slide through hole 34, such as by a simple knot. Tieline 42 extends from hole 34 in first arm 12 to hole 36 in second arm 14 and then through hole 40 in first handle portion 16. Holes 34, 36 are located intermediate their respective spring hole 24, 26 and fastener 32. The end of tie-line 42 extending through hole 40 is used to connect the mooring device to a boat to be secured. As seen in FIG. 2, eye bolt 38 preferably is fastened to hole 36 to accommodate tie-line 42 in sliding relation to second arm 14. In this way, when tie-line 42 is tensioned by the drift of the boat away from the point of fastening, tie-line 42 slides with respect to eye bolt 48 and hole 40 to tighten the jaw portion upon the point of fastening.

In operation, the user draws the handle portions together, causing the first and second arms to open outwardly about the pivot point. The jaw portion is then clamped about a stationary object to which the boat is to be moored, as seen in FIG. 3. To detach the boat, the user merely draws the handle portions together once more to open the jaw portion and release the grip of the stationary object. All of this may be accomplished quickly and safely using only one hand. Moreover, the construction of the present invention provides for ease of replacement of worn parts. For example, the spring may be easily and conveniently detached by merely unhooking it from holes 24 and 26 for replacement.

The foregoing is for illustrative purposes only. It is contemplated that modifications may be made, obvious to one of oridinary skill in the art, particularly with regard to matters of shape, size, and arrangement of parts, within the scope of the invention as defined by the broad general terms in which the appended claims are expressed.

What is claimed is:

1. A mooring device for detachably securing a boat to any convenient stationary object, said device comprising:

first and second opposed, inwardly curving arms forming a jaw portion;

a first handle portion extending from one end of said first arm and a second handle portion extending from one end of said second arm;

fastener means for connecting said first and second arms adjacent said handle portions at a fastening point;

a resilient member coupled between said first arm and said second arm, said resilient member holding said jaw portion in a normally closed position while yielding to allow said jaw portion to open when said handle portions are drawn together; and tie-line means for connecting said device to a boat to be secured, said tie-line means extending from said first arm to said second arm, and from said second arm to said first handle portion, and being fixedly attached to said first handle portion.

2. A mooring device as in claim 1 wherein said resilient member is a spring.

3. A mooring device as in claim 2 further comprising a spring hole formed in each of said arms intermediate the ends of said arms to accommodate said spring.

4. A mooring device as in claim 1 wherein the other ends of said first and second arms have a hook portion to facilitate gripping of the stationary object.

5. A mooring device as in claim 1 wherein said fastener means is a bolt.

6. A mooring device as in claim 1 further comprising a spacer element disposed between said first arm and said second arm at said fastening point.

7. A mooring device for detachably securing a boat to any convenient stationary object, said device comprising:

first and second opposed, inwardly curving arms forming a jaw portion;

a first handle portion extending from one end of said first arm and a second handle portion extending from one end of said second arm;

fastener means for connecting said first and second arms adjacent said handle portions at a fastening point;

a resilient member coupled between said first arm and said second arm, said resilient member holding said jaw portion in a normally closed position while yielding to allow said jaw portion to open when said handle portions are drawn together; and tie-line means for connecting said device to a boat to be secured, said tie-line means extending from said first arm to said second arm, and from said second arm to said first handle portion, wherein said tie-line means is coupled to a first tie-line hole formed in said first arm intermediate said resilient member and said fastener means and said tie-line means is coupled to a third tie-line hole formed in said first handle portion.

8. A mooring device as in claim 7 further comprising an eye bolt for connecting said tie-line means to said second arm, said eye bolt disposed in a second tie-line hole formed in said second arm intermediate said resilient member and said fastener means, said tie-line means being slidable within said eye bolt.

9. A mooring device as in claim 7 wherein said resilient member is a spring.

10. A mooring device as in claim 9 further comprising a spring hole formed in each of said arms intermediate the ends of said arms to accommodate said spring.

11. A mooring device as in claim 7 wherein the other ends of said first and second arms have a hook portion to facilitate gripping of the stationary object.

12. A mooring device as in claim 7 wherein said fastener means is a bolt.

13. A mooring device as in claim 7 further comprising a spacer element disposed between said first arm and said second arm at said fastening point.

* * * * *